US006145492A

United States Patent [19]

Lixl

[11] Patent Number: 6,145,492

[45] Date of Patent: Nov. 14, 2000

[54] CONTROL VALVE FOR A FUEL INJECTION VALVE

[75] Inventor: Heinz Lixl, Burgweinting, Germany

[73] Assignee: Siemens Aktiengesellschaft, Munich, Germany

[21] Appl. No.: 09/314,191

[22] Filed: May 19, 1999

[30] Foreign Application Priority Data

May 19, 1998 [DE] Germany ..... 198 22 503

[51] Int. Cl.[7] ..... F02M 47/02

[52] U.S. Cl. ..... 123/467; 123/514; 239/96

[58] Field of Search ..... 123/467, 514, 123/506; 239/96

[56] References Cited

U.S. PATENT DOCUMENTS

| | | | |
|---|---|---|---|
| 4,899,935 | 2/1990 | Yoshida | 239/91 |
| 5,419,492 | 5/1995 | Gant et al. | 239/88 |
| 5,769,319 | 6/1998 | Yen et al. | 239/90 |
| 5,860,597 | 1/1999 | Tarr | 239/124 |
| 5,979,790 | 11/1999 | Gurich et al. | 239/88 |

FOREIGN PATENT DOCUMENTS

| | | |
|---|---|---|
| 0 778 411 A2 | 6/1997 | European Pat. Off. . |
| 0 826 876 A1 | 3/1998 | European Pat. Off. . |
| 196 24 001 A1 | 12/1997 | Germany . |
| 197 40 997 A1 | 3/1998 | Germany . |

*Primary Examiner*—Henry C. Yuen
*Assistant Examiner*—Arnold Castro
*Attorney, Agent, or Firm*—Herbert L. Lerner; Laurence A. Greenberg; Werner H. Stemer

[57] ABSTRACT

A control valve for an injection valve for injecting fuel into an internal combustion engine is described. The injection valve has a control chamber which is connected via an inlet throttle to a high-pressure accumulator, and which can be connected via the control valve and an outlet throttle to an unpressurized return line to a fuel tank. The pressure prevailing in the control chamber acts on a movable nozzle body which is provided with a nozzle needle which releases and seals injection holes as the nozzle body moves. The control valve is constructed adjoining the control chamber, with the result that the pressure prevailing in the control chamber at a first operating surface also acts on the valve body of the control valve. The control valve has a valve chamber which is disposed opposite the control chamber and is connected to the control chamber via the outlet throttle and has a second operating surface, which is smaller than the first operating surface.

7 Claims, 3 Drawing Sheets

CONTROL VALVE FOR A FUEL INJECTION VALVE

BACKGROUND OF THE INVENTION

Field of the Invention

The invention relates to a control valve for an injection valve for injecting fuel into internal combustion engines. Such a control valve is known from Published, European Patent Application EP 0 826 876.

For the purpose of supplying fuel to internal combustion engines, increasing use is being made of accumulator injection systems which operate with very high injection pressures. Such injection systems are known as common rail systems (for diesel engines) and HPDI injection systems (for spark-ignition engines). The injection systems are distinguished by the fact that the fuel is conveyed by a high-pressure pump into a pressure accumulator that is common to all the cylinders of the engine and from which the injection valves at the individual cylinders are supplied. The opening and closing of the injection valves are controlled as a rule electromagnetically, possibly also with the aid of piezoelements.

The purpose of the control valve is to effect hydraulic opening and closing of the actual fuel injection valve, that is to say, in particular, to fix the beginning and the end of the injection process exactly in terms of time. The injection valve is intended, for example, to open under control and to close quickly at the end of the injection process. Then, the injection of very small amounts of fuel is to be possible for the purpose of pilot injection before the actual injection with the aid of which the combustion process can be optimized.

In the above-named Published, European Patent Application EP 0 826 876 and in Published, European Patent Application EP 0 778 411, a 2/2 directional valve is used as control valve for a common rail system.

SUMMARY OF THE INVENTION

It is accordingly an object of the invention to provide a control valve for a fuel injection valve which overcomes the above-mentioned disadvantages of the prior art device of this general type, in which the control valve is configured such that the control forces to be applied are small in conjunction with a simple configuration of the valve.

With the foregoing and other objects in view there is provided, in accordance with the invention, in an injection valve having a control chamber to be connected via an inlet throttle to a high-pressure accumulator for injecting fuel into an internal combustion engine, the control chamber to be further connected to a fuel tank via an unpressurized return line, the injection valve further having a nozzle seat and a movable nozzle body with nozzle needles for communicating with injection holes formed in the injection valve, a control valve, including:

an axially movable valve body having a first operating surface adjoining the control chamber, the valve body having on a side opposite the first operating surface a sealing surface cooperating with a valve seat of the injection valve;

an outlet throttle disposed in the valve body for connecting the control chamber to the unpressurized return line and dimensioned in comparison with the inlet throttle such that a pressure drop at the inlet throttle is greater than a pressure drop at the outlet throttle;

the valve body has a valve chamber formed therein disposed opposite the control chamber and connected to the control chamber via the outlet throttle and further disposed in a flow direction downstream of the outlet throttle and upstream of the sealing surface; and the valve body further having a second operating surface defined by the valve chamber and acting in a fashion opposed to the first operating surface and being smaller than the first operating surface, the sealing surface of the valve body to be lifted from the valve seat for connecting the control chamber to the unpressurized return line via the outlet throttle, a pressure prevailing in the control chamber acting on the movable nozzle body having the nozzle needle for releasing and sealing the injection holes as the nozzle body moves.

The invention accordingly represents a 2/2 directional valve integrated into the injection valve body. The control valve according to the invention is of very simple construction and fully integrated into the injection valve body, and requires only small control forces. The particular configuration of the control valve according to the invention renders it possible to minimize the volume of the valve space. The control valve, throttles and injection valve body form a compact unit. There is no need on the control valve for any springs or similar devices for producing prestresses. The control valve according to the invention can be configured for very small stroke movements with a stroke of only 20 to 40 $\mu$m.

Other features which are considered as characteristic for the invention are set forth in the appended claims.

Although the invention is illustrated and described herein as embodied in a control valve for a fuel injection valve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
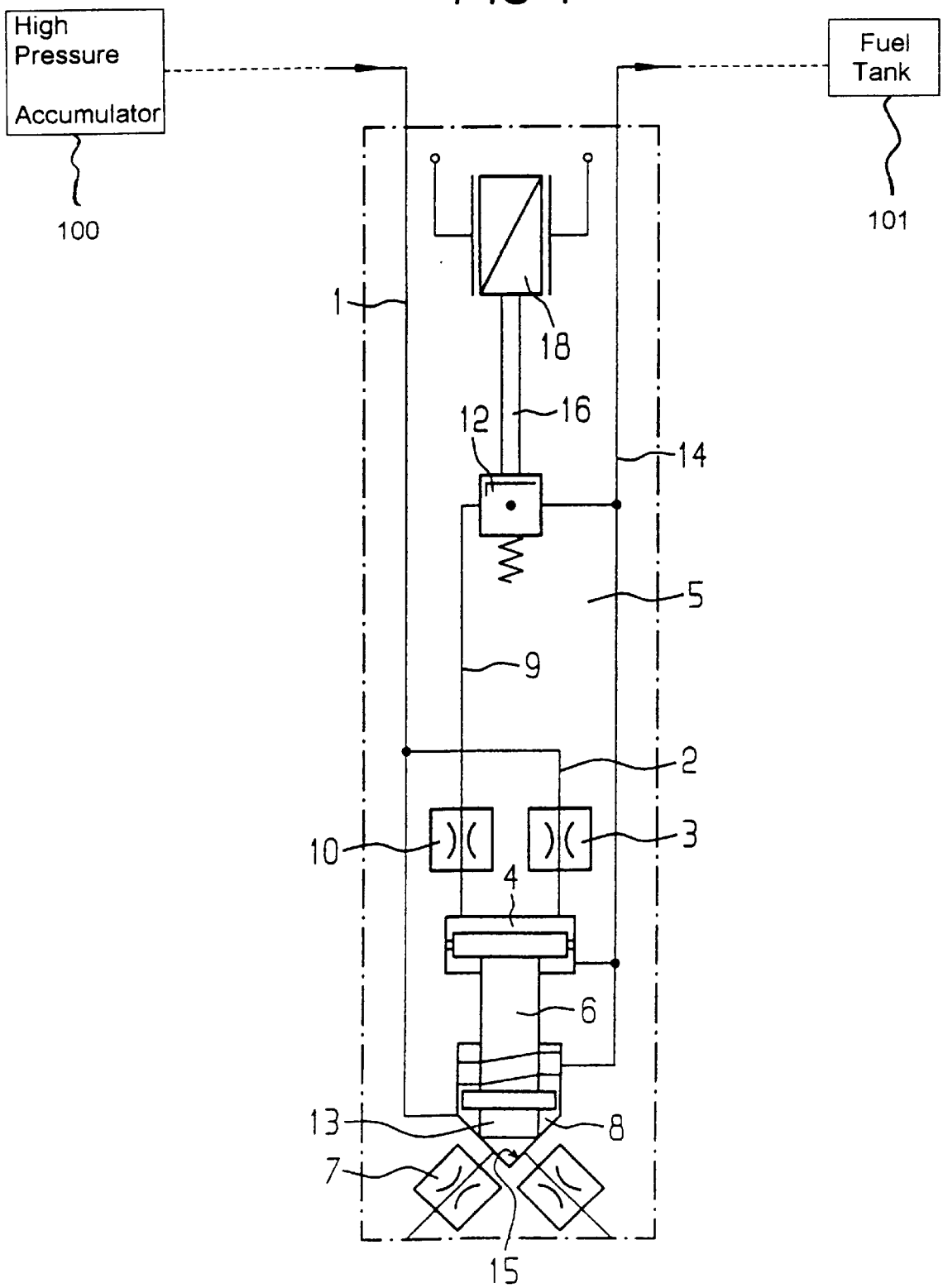
PRIOR ART FIG 1
FIG. 1 is a diagrammatic, block diagram of a known injection valve with a 2/2 directional valve as a control valve.

In all the figures of the drawing, sub-features and integral parts that correspond to one another bear the same reference symbol in each case. Referring now to the figures of the drawings in detail and first, particularly, to FIG. 1 thereof, there is shown a known injection valve with a 2/2 directional valve as a control valve 12.

As shown in FIG. 1, in the case of a common rail system fuel is led with system pressure from a high-pressure accumulator 100 to a control chamber 4 in an injection valve body 5 via a high-pressure bore 1 and an inlet bore 2 with an inlet throttle 3. In the control chamber 4, the pressure prevailing there acts on a rear end of a movable nozzle body 6 with a nozzle needle 13 at a front end which, as the nozzle body 6 moves, opens and closes in the injection valve body 5 injection holes 7 which lead to the combustion chamber of the internal combustion engine. Likewise connected to the high-pressure accumulator via the high-pressure bore 1 is a nozzle chamber 8 which is constructed at the front end of the nozzle body 6 in the injection valve body 5. If the full system pressure is present both in the control chamber 4 and in the nozzle chamber 8, the nozzle body 6 is pressed downward because of the larger operating surface in the control chamber 4, and the nozzle needle 13 then bears against a valve seat 15 in the nozzle chamber 8 and seals the injection holes 7.

From the control chamber 4, a bore 9 in the injection valve body 5 with an outlet throttle 10 leads to the control valve 12, in the form of a 2/2 directional valve, integrated into the injection valve body 5. An unpressurized fuel return line 14 departs from the control valve 12 to a fuel tank 101. The control valve 12 is driven and operated via a plunger 16 by an electromagnetic and/or piezoelectric actuator 18.

The control valve 12 controls the pressure that is exerted in the control chamber 4 on the movable nozzle body 6. If the control valve 12 is closed, the full system pressure is essentially present in the control chamber 4, with the result that the nozzle needle 13 seals the injection holes 7, which lead into the combustion chamber, at the front end of the nozzle body 6. If the actuator 18 is electrically driven, the plunger 16 exerts a force on the spring-loaded control valve 12. The control valve 12 opens as a consequence thereof. When the control valve 12 is open, a stationary flow is set up between the high-pressure accumulator, control chamber 4, control valve 12 and return line 14. This flow leads to a defined pressure drop at the individual throttles, the inlet throttle 3 and the outlet throttle 10. The pressure drop at the inlet throttle 3 and the outlet throttle 10 is dimensioned in each case such that the pressure in the control chamber 4 is reduced. As a result, the force acting in the control chamber 4 on the nozzle body 6 decreases, while the pressure in the nozzle chamber 8 remains equal to the system pressure, with the result that the injection valve is opened hydraulically by the force exerted in the nozzle chamber 8 on the nozzle body 6. As a result, the connection between the nozzle chamber 8 and the injection holes 7 is established, and the fuel is injected into the combustion chamber.

This configuration has the disadvantage that the pressure acting on the control valve 12 in the closed state is essentially equal to the system pressure, that is to say is very high. Since, in the known configuration, this pressure acts on the control valve 12 in the opening direction, the closing spring of the control valve 12 must be strong in order to keep the control valve 12 closed. This, in turn, leads to the fact that the force required to open the control valve, which is to be applied by the actuator 18, is very large.

In order to eliminate this disadvantage, it is proposed in Published, European Patent Application EP C 778 411 A2 to provide the control valve with a pressure-compensating chamber and a pressure-compensating piston. As before, in this case the control valve is connected to the control chamber via a bore in the injection valve body with an outlet throttle. In a development of this configuration, the outlet bore is fitted in a movable, spring-loaded throttle piston that is disposed between the control chamber and control valve. The configuration for controlling the nozzle body of the injection valve is therefore very complicated.

Figure 2:
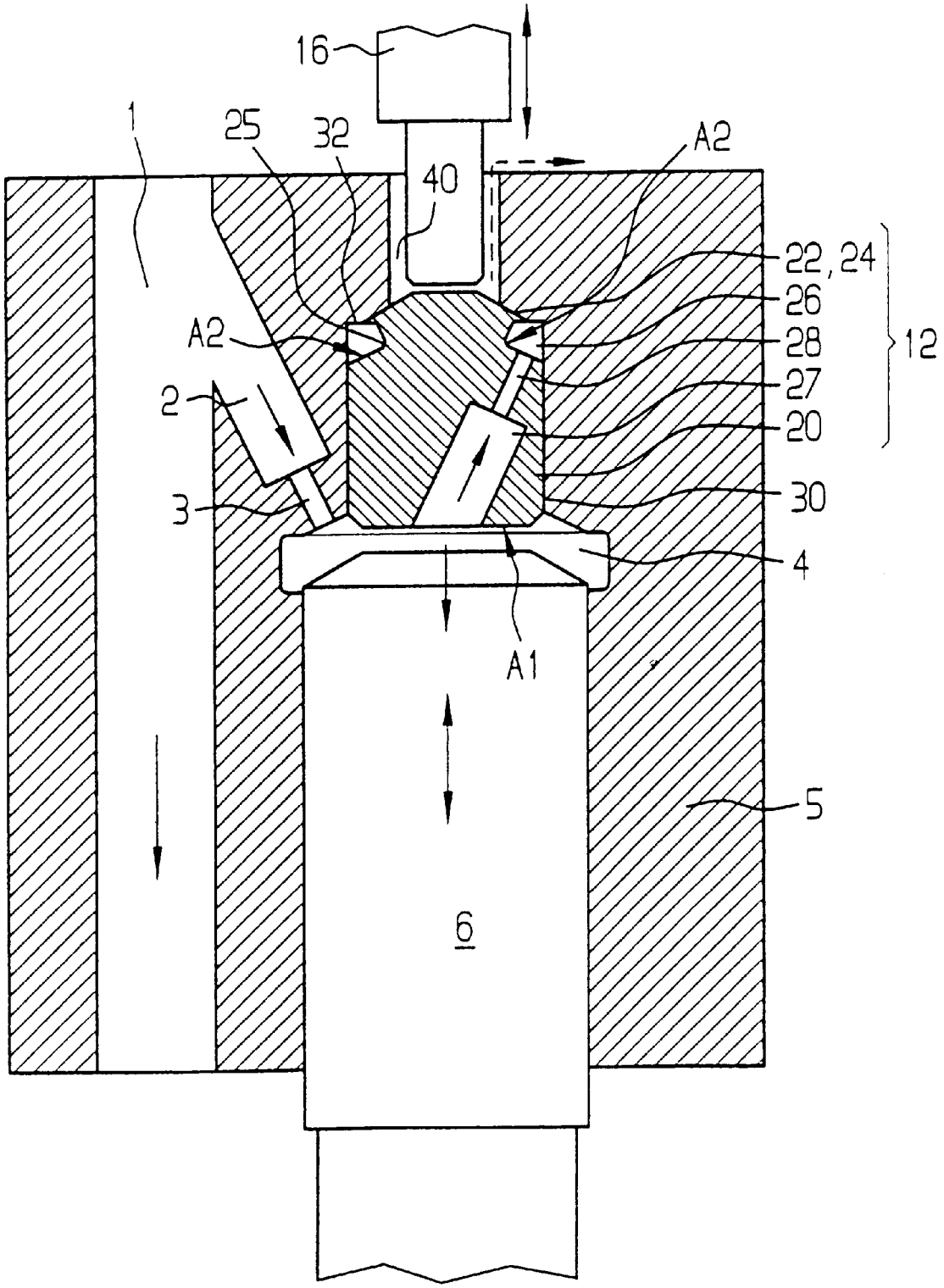
FIG. 2 is a sectional view of the injection valve with a control valve according to the invention.

As in the case of FIG. 1, in the injection valve according to the invention as shown in FIG. 2, the control chamber 4 of the injection valve is also connected via the high-pressure bore 1 and the inlet bore 2 with the inlet throttle 3 in the injection valve body 5 to the high-pressure accumulator 100, which is at system pressure. Although no longer represented in FIG. 2, here, as well, the high-pressure bore 1 leads further to the nozzle chamber 8 at the front end of the movable nozzle body 6, which projects with its rear end into the control chamber 4 and forms a side of the control chamber 4.

In the embodiment according to the invention shown in FIG. 2, the control valve 12 is disposed directly adjoining the control chamber 4. Constructed for this purpose in the injection valve body 5 is a cutout 30 which extends away from the control chamber 4 in the longitudinal direction of the injection valve body 5 with respect to the nozzle body 6 or the bore intended for holding the nozzle body 6. A valve body 20 is inserted into the cutout 30. Like the nozzle body 6, a valve body 20 of the control valve 12 can also move in the longitudinal direction of the injection valve body 5, but it is fitted in a sealing fashion into the cutout 30.

The cutout 30 is open toward the control chamber 4, with the result that the valve body 20 inserted into the cutout 30 projects into the control chamber 4 with a surface $A_1$ (its base surface) and forms a side of the control chamber 4 with the surface $A_1$. As a rule, this side is situated opposite the side of the control chamber 4 that is formed by the nozzle body 6.

On the other side (the top side) of the cutout 30, which is averted from the control chamber 4, there is provided in the injection valve body 5 a bore 40 through which the plunger 16 of the electromagnetic and/or piezoelectric actuator 18 (not represented in FIG. 2) runs. The diameter of the plunger 16 is smaller than that of the bore 40, and the bore 40 forms a part of the unpressurized return line through which the fuel flows back from the control chamber 4 into the fuel tank 101 when the control valve 12 is open.

The bore 40, in turn, has a smaller diameter than the cutout 30. The transition from the bore 40 into the cutout 30 is constructed as a valve seat 24 for the control valve 12, at which, with the control valve 12 closed, a sealing surface 22 of the valve body 20 comes to bear in a sealing manner against the top side of the cut out 30 having the valve seat 24, that is to say at the side of the valve body 20 averted from the control chamber 4.

On its outer circumference, the valve body 20 has a radial shoulder or a radial constriction 25 adjoining the sealing surface 22 corresponding to the valve seat 24. At a spacing from the top side of the valve body 20 and from the sealing surface 22, the constriction 25 widens in a stepwise fashion to the outside diameter of the valve body 20 which corresponds to the inside diameter of the cutout 30. Together with a radial shoulder 32 at the upper end of the cutout 30, the constriction 25 produces a valve chamber 26 at the upper end of the control valve 12.

With reference to the pressure prevailing in the valve chamber 26, the constriction 25 has an annular operating surface $A_2$ which is situated opposite the operating surface $A_1$ on the underside of the valve body 20, and which is smaller than the operating surface $A_1$. The ratios are therefore similar to the case of the nozzle body 6, which moves up and down taking account of the different operating surfaces at its upper and lower ends, respectively, as a function of the pressures in the control chamber 4 and the nozzle chamber 8.

An outlet bore 27 with an outlet throttle 28 is integrated into the valve body 20. The outlet bore 27 with the outlet throttle 28 extends from the control chamber 4 to the valve chamber 26, that is to say from the side of the valve body 20 adjoining the control chamber 4 or projecting into the latter to the constriction 25.

In the initial state, with the injection valve closed, the valve body 20 of the control valve 12 is pressed against the valve seat 24 by the pressure in the control chamber 4, which corresponds virtually to the system pressure, with the result that there is no connection between the valve chamber 26 and the bore 40, which is part of the unpressurized return line to the fuel tank. It is true that essentially the same pressure as in the control chamber 4 is present in the valve chamber 26 via the outlet bore 27 and the outlet throttle 28, but because the surface $A_1$, via which the pressure acts from the side of the control chamber 4 on the valve body 20, is larger than the surface $A_2$, via which the pressure acts in the opposite direction in the valve chamber 26, the resulting force is directed toward the valve seat 24.

The system pressure is also present in the control chamber 4 at the nozzle body 6, with the result that the nozzle needle 13 is pressed into its seat 15 at the front end of the nozzle body 6, and the connection to the injection holes 7 is interrupted. Consequently, no fuel is injected into the combustion chamber.

In the case when the actuator 18 is driven electrically, the plunger 16 exerts on the control valve 12 a force that lifts the valve body 20 off the valve seat 24. Since a force acting in the opening direction is already present at the operating surface $A_2$ of the valve chamber 26, the force exerted by the plunger 16 need no longer overcome the difference relative to the force acting on the larger operating surface $A_1$.

A connection is produced between the valve chamber 26 and the bore 40, which is part of the unpressurized return line to the fuel tank, when the valve body 20 lifts off the valve seat 24. Fuel thereby flows from the high-pressure bore 1 through the inlet throttle 3, the control chamber 4, the outlet throttle 28 and the valve chamber 26 into the bore 40. The diameter of the outlet throttle 28 is larger than the diameter of the inlet throttle 3 in the injection valve body 5. The flow through the inlet throttle 3 is therefore less than that through the outlet throttle 28, with the result that the pressure in the control chamber 4 decreases. The nozzle body 6 is thereby relieved, and the system pressure present in the nozzle chamber 8 (FIG. 1) lifts the nozzle needle 13 off its seat 15 and opens the connection to the injection holes 7. The injection process thereby begins.

The stroke of the valve body 20 when lifting off the valve seat 24, and the stroke of the nozzle body 6, which is directed opposite to this movement, can be coordinated such that the underside of the valve body 20 comes to bear against the top side of the nozzle body 6. Since both are plane surfaces, the outlet bore 27 opening into the underside of the valve body 20 is thereby sealed. As a consequence of this, essentially no more fuel flows off through the return line. At the same time, the pressure in the control chamber 4 is increased.

This measure has the advantage that the leakage flow of the injection valve, and thus the fuel unnecessarily conveyed, are reduced. However, it need not be provided in each case.

After termination of the driving of the actuator 18, the valve body 20 is pressed against the valve seat 24 by the pressure in the control chamber 4, which is always higher than the pressure in the valve chamber 26, which is connected to the unpressurized return line. Consequently, the connection to the bore 40 and to the unpressurized return line is interrupted, with the result that the full pressure can build up again in the control chamber 4. The pressure in the control chamber 4 leads to a force at the nozzle body 6 acting in a direction of the seat 15 of the nozzle needle 13 that presses the nozzle needle 13 into its seat 15 again and terminates the injection process.

Figure 3:
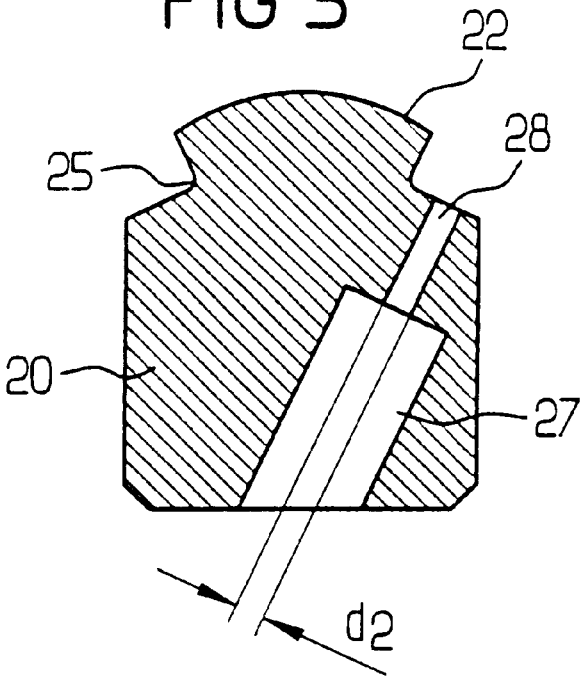
FIG. 3 is a sectional view a first embodiment of a valve body for the control valve shown in FIG. 2.

The embodiment of the valve body 20 used in the case of the injection valve of FIG. 2 is represented in detail in FIG. 3. The outlet bore 27 with the outlet throttle 28 runs from the underside of the valve body 20, which adjoins the control chamber 4, obliquely through the valve body 20, and opens directly into the constriction 25 below the sealing surface 22.

Figure 4:
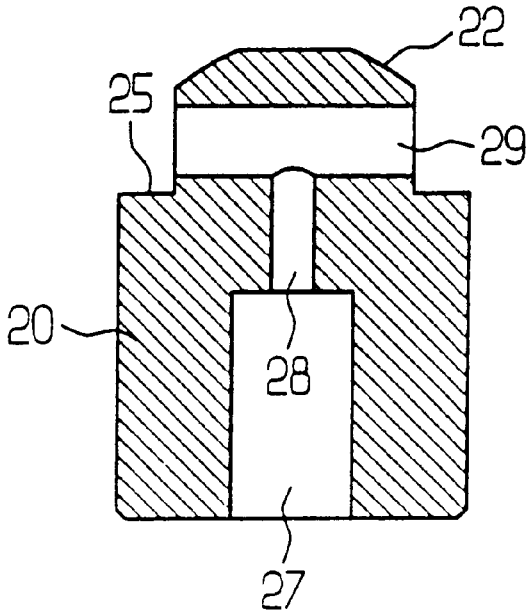
FIG. 4 is a sectional view of a second embodiment of the valve body for the control valve shown in FIG. 2.

FIG. 4 shows an alternative embodiment of the valve body 20. In this embodiment, the outlet bore 27 with the outlet throttle 28 runs in the direction of the longitudinal axis of the valve body 20 from the underside of the valve body 20, which adjoins the control chamber 4, through the valve body 20, and opens into a transverse bore 29 which runs perpendicular to the longitudinal axis through the valve body 20, and which opens into the constriction 25 below the sealing surface 22.

I claim:

1. In an injection valve having a control chamber to be connected via an inlet throttle to a high-pressure accumulator for injecting fuel into an internal combustion engine, the control chamber to be further connected to a fuel tank via an unpressurized return line, the injection valve further having a nozzle seat and a movable nozzle body with nozzle needles for communicating with injection holes formed in the injection valve, a control valve, comprising:

an axially movable valve body having a first operating surface adjoining the control chamber, said valve body having on a side opposite said first operating surface a sealing surface cooperating with a valve seat of the injection valve;

an outlet throttle disposed in said valve body for connecting the control chamber to the unpressurized return line and dimensioned in comparison with the inlet throttle such that a pressure drop at the inlet throttle is greater than a pressure drop at the outlet throttle;

said valve body having a valve chamber formed therein disposed opposite the control chamber and connected to the control chamber via said outlet throttle and further disposed in a flow direction downstream of said outlet throttle and upstream of said sealing surface; and said valve body further having a second operating surface defined by said valve chamber and acting in a fashion opposed to said first operating surface and being smaller than the first operating surface, said sealing surface of said valve body to be lifted from the valve seat for connecting the control chamber to the unpressurized return line via said outlet throttle, a pressure prevailing in the control chamber acting on the movable nozzle body having the nozzle needle for releasing and sealing the injection holes as the nozzle body moves.

2. The control valve according to claim 1, wherein said outlet throttle is integrated into said valve body.

3. The control valve according to claim 1, wherein said valve body has a top side and said second operating surface of said valve chamber is defined by a constriction formed on said top side of said valve body.

4. The control valve according to claim 3, wherein said valve body has an underside adjoining said control chamber and an outlet bore formed therein fluidically communicating with said outlet throttle, said outlet bore in combination with said outlet throttle running from said underside of said valve body directly to said constriction on said top side of said valve body.

5. The control valve according to claim 3, wherein said valve body has a longitudinal axis, an underside adjoining the control chamber, an outlet bore formed therein fluidically communicating with said outlet throttle, and a transverse bore formed therein running at a level of said constriction on said top side, perpendicular to said longitudinal axis, and opening into said constriction, said outlet bore in combination with said outlet throttle running from said underside of said valve body to said transverse bore opening into said constriction.

6. The control valve according to claim 1, wherein by lifting said valve body off of the valve seat and by lifting the nozzle needle off of the nozzle seat, the nozzle body and said valve body are moved onto one another, with a result that an outflow via the outlet throttle is reduced.

7. The control valve according to claim 6, wherein the nozzle body of the injection valve has a top side facing said first operating surface of said valve body and is constructed at least partially as a sealing surface, and if the nozzle needle is lifted off of the nozzle seat and with said valve body lifted off of the valve seat said underside of said valve body is positioned against the top side of the nozzle body and an outflow via said outlet throttle is prevented.

* * * * *